US010218076B1

(12) United States Patent
Bhardwaj et al.

(10) Patent No.: US 10,218,076 B1
(45) Date of Patent: Feb. 26, 2019

(54) HEXAGONAL WAVEGUIDE BASED CIRCULARLY POLARIZED HORN ANTENNAS

(71) Applicants: Shubhendu Bhardwaj, Miami, FL (US); John Volakis, Miami, FL (US)

(72) Inventors: Shubhendu Bhardwaj, Miami, FL (US); John Volakis, Miami, FL (US)

(73) Assignee: The Florida International University Board of Trustees, Miami, FL (US)

( * ) Notice: Subject to any disclaimer, the term of this patent is extended or adjusted under 35 U.S.C. 154(b) by 0 days.

(21) Appl. No.: 16/126,073

(22) Filed: Sep. 10, 2018

(51) Int. Cl.
*H01Q 13/00* (2006.01)
*H01Q 13/02* (2006.01)

(52) U.S. Cl.
CPC ..... *H01Q 13/0241* (2013.01); *H01Q 13/0275* (2013.01)

(58) Field of Classification Search
None
See application file for complete search history.

(56) References Cited

U.S. PATENT DOCUMENTS 3,815,136 A * 6/1974 Rootsey ..... G01S 3/146 342/362
4,857,324 A * 8/1989 Mir ..... A61K 33/08 424/690
5,818,395 A * 10/1998 Wolcott ..... H01Q 1/08 343/753
6,137,450 A * 10/2000 Bhattacharyya ..... H01Q 13/02 343/776
6,879,298 B1 * 4/2005 Zarro ..... H01Q 13/025 343/756
2005/0237253 A1 * 10/2005 Kuo ..... H01P 1/173 343/772
2010/0078203 A1 * 4/2010 Lier ..... H01Q 13/02 174/258

OTHER PUBLICATIONS

Bhardwaj et al., "Hexagonal Waveguide Based Circularly Polarized Horn Antennas for Sub-mm-Wave/Terahertz Band", IEEE Transactions on Antennas and Progagation, vol. 66, No. 7, Jul. 2018, pp. 3366-3374.

Gan et al., "Design of Broadband Circular Polarization Truncated Horn Antenna with Single Feed", Progress in Electromagnetics Research C, vol. 24, 2011, pp. 197-206.

* cited by examiner

*Primary Examiner* — Trinh Dinh
(74) *Attorney, Agent, or Firm* — Saliwanchik, Lloyd & Eisenschenk

(57) ABSTRACT

A circularly polarized horn antenna can comprise a rectangular waveguide, a hexagonal waveguide connected to the rectangular waveguide, a first transition part connected to the hexagonal waveguide, and a horn connected to the first transition part. The horn can include a first corrugated inner surface, and the first transition part can include a second corrugated inner surface.

20 Claims, 8 Drawing Sheets

HEXAGONAL WAVEGUIDE BASED CIRCULARLY POLARIZED HORN ANTENNAS

BACKGROUND

A circularly polarized horn antenna is used for transmitting and receiving circularly polarized signals for wireless communication, radar, and imaging applications. Such horns are typically easy to design and fabricate for microwave frequency bands. But for millimeter wave (mm-wave) and terahertz frequency applications, micro-fabrication techniques are needed for such fabrications, which can make them expensive. The immediate application of the antenna is for mm-wave wireless communication. The antenna would be relevant for a variety of sub-mm-wave and terahertz bands, as the communication and imaging applications gain interest and popularity at these frequencies.

Currently, the technology used for circularly polarized horns are 1) by using a septum (or waveguide partitions, discontinuities and irises) and 2) by using an orthogonal mode transducer (OMT). The former uses a metallic partition within the waveguide section for linear-polarization to circular-polarization conversion. The partition contains sub-wavelength (small) features that require precise fabrication, alignment and placement within the waveguide. Even with existing micro-/nano-fabrication methods, it is a challenging task for sub-mm-wave and terahertz frequency designs. This is due to the shrinking dimensions of the waveguides (1 mm or less thickness) and small features of the partition itself. Ultimately, the design becomes expensive and sensitive to fabrication tolerances rendering it not very viable for high frequency applications. The latter technique (i.e., OMT) requires rigorous assemblies of waveguide sections, requiring 3D metal fabrication techniques with high precision and low surface roughness. Again, fabrication of such 3-dimensional waveguide networks is challenging and expensive for high frequency applications owing to small dimensions.

BRIEF SUMMARY

Embodiments of the subject invention provide novel and advantageous circularly polarized horn antennas that comprise a hexagonal waveguide and a horn including a corrugated inner surface, thereby providing a simple and easy fabrication antenna for sub-mm-wave and terahertz band communication.

The circular polarizers of embodiments of the subject invention may be classified as left handed (LH) circular polarizers and right handed (RH) circular polarizers. Embodiments provide LH polarizer and RH polarizers (as opposed to previous LH) that use structures with hexagonal waveguides that are mirror images of some related art devices. The antenna structures share common features with the polarizers but have distinction that one or more types of cross-section may expand (or taper) from one end to another. The antenna structure additionally comprises corrugated surfaces applied within the hexagonal and square cross-sectional regions of the waveguide. Embodiments of the subject invention are made of metallic surfaces, realized using a variety of metals, such as copper, aluminum, and gold, among others. Generally, embodiments can be realized by a variety of methods by cutting metal from solid metal block.

In an embodiment, a circularly polarized horn antenna can comprise: a hollow waveguide including a rectangular waveguide and a hexagonal waveguide connected to the rectangular waveguide; and a horn connected to the hexagonal waveguide. The horn can include a first corrugated inner surface.

In another embodiment, a circularly polarized horn antenna can comprise: a rectangular waveguide; a hexagonal waveguide connected to the rectangular waveguide; a first transition part connected to the hexagonal waveguide; and a horn connected to the first transition part. The horn can include a first corrugated inner surface, and the first transition part can include a second corrugated inner surface.

In yet another embodiment, a circularly polarized horn antenna can comprise: a rectangular waveguide; a rectangular to square transition part connected to the rectangular waveguide; a square to hexagonal transition part connected to the rectangular to square transition part; a hexagonal waveguide connected to the square to hexagonal transition part; a first transition part connected to the hexagonal waveguide; and a pyramidal horn connected to the first transition part. The pyramidal horn can include a first plurality of grooves having a constant or variable depth, and the first transition part can include a second plurality of grooves having a constant or variable depth.

BRIEF DESCRIPTION OF DRAWINGS

FIG. 1(*b*) shows a circularly polarized horn antenna according to an embodiment of the subject invention.

FIG. 1(*c*) shows a circularly polarized horn antenna having a tapered hexagonal waveguide according to an embodiment of the subject invention.

FIG. 1(*d*) shows a circularly polarized horn antenna having a square end aperture according to an embodiment of the subject invention.

FIG. 2(*b*) shows a circularly polarized horn antenna having a corrugated inner surface according to an embodiment of the subject invention.

FIG. 2(*c*) shows a circularly polarized horn antenna having a corrugated inner surface according to an embodiment of the subject invention.

FIG. 6(*b*) shows a circularly polarized horn antenna having conical outer structure according to an embodiment of the subject invention.

DETAILED DESCRIPTION

Figure 1A:
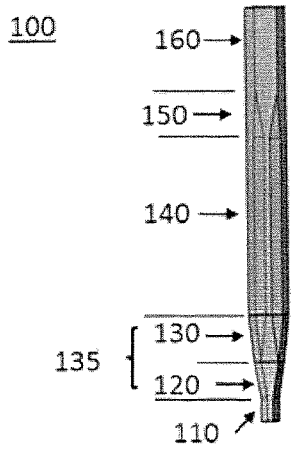
FIG. 1(*a*) shows a hollow waveguide polarizer according to an embodiment of the subject invention.
Figure 1B:
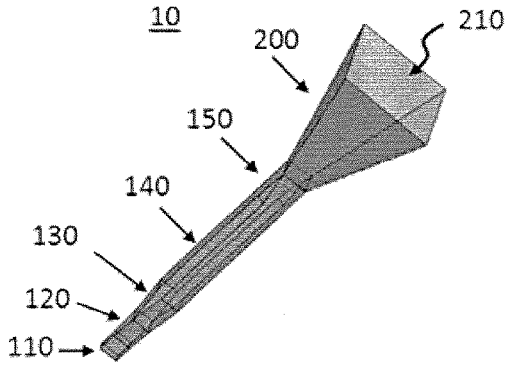
Figure 1C:
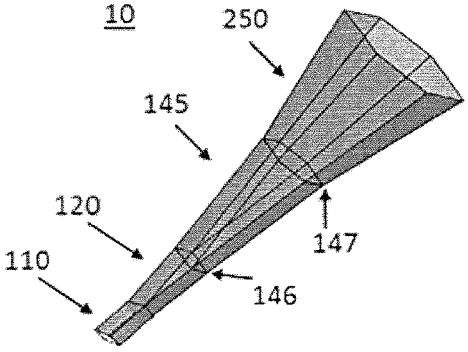
Figure 1D:
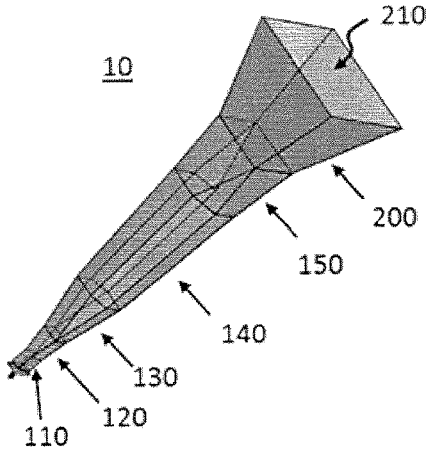

Embodiments of the subject invention provide novel and advantageous circularly polarized horn antennas that comprise a hexagonal waveguide and a horn including a corrugated inner surface, thereby providing a simple and easy fabrication antenna for sub-mm-wave and terahertz band communication.

A traditional circularly polarized horn antenna comprises a transverse electric (TE) waveguide, a transverse magnetic (TM)/TE waveguide, a flare between the TE waveguide and the TM/TE waveguide, and a septum of a partition formed on the TE waveguide, or comprises an orthomode transducer (OMT). Therefore, it is very difficult to fabricate such a circularly polarized horn antenna, specially at mm-wave and terahertz frequencies, where dimensions are scaled down.

By contrast, embodiments of the subject invention present a new class of circularly polarized (CP) horn antennas for wireless communication, imaging, and radar applications. Circularly polarized transmission of embodiments can be used in scenarios where transmitter and receiver may have a relative rotation that could otherwise lead to polarization mismatch. Satellite communication and mobile communication are some examples. In an embodiment, the hexagonal waveguide based circularly polarized horn antennas are used as feeder for parabolic reflectors used for long distance CP communication. Embodiments provide a class of horn antennas that are easy to fabricate at mm-wave, sub-mm-wave and terahertz frequencies as they allow linear to circular polarization conversion using hollow waveguides.

Embodiments of the subject invention provide a wideband circularly polarized radiation using simple, hollow and easy-to-fabricate waveguides. Specifically, the designs can be based on hexagonal waveguides that allow conversion of a linearly polarized (LP) wave to a circularly polarized (CP) wave. Embodiments are easier to fabricate for sub-mm-wave and terahertz band communication, where sub-mm length features need to be fabricated, and embodiments are simpler than the traditionally existing configurations.

FIG. 1(*a*) shows a hollow waveguide polarizer according to an embodiment of the subject invention. FIG. 1(*a*) shows a basic form of a hollow waveguide having hexagonal cross section that can convert linearly polarized (LP) waves to circularly polarized (CP) waves.

Referring to FIG. 1(*a*), in an embodiment, a hollows waveguide 100 comprises a rectangular waveguide 110 and a hexagonal waveguide 140. The incoming LP wave is fed at the rectangular waveguide 110 and is converted to a CP wave as it propagates through the hexagonal waveguide 140. That is, the hexagonal waveguide 140 provides a polarizer section. The hollow waveguide 100 further comprises a rectangular-to-square transition part 120 and a square-to-hexagonal transition part 130 between the rectangular waveguide 110 and the hexagonal waveguide 140; thereby allowing the cross sections to transform piecewise continuously from rectangle to hexagon. The hollow waveguide 100 further comprises a first transition part 150 transforming hexagonal cross section to square cross section. In addition, the hollow waveguide 100 can comprise a square waveguide 160 connected to the first transition part 150. The hollow waveguide 100 is a hollow structure and the inner surface is made of an electrical conductor such as a metal, copper, aluminum, and etc.

FIGS. 1(*b*)-1(*d*) show circularly polarized horn antennas according to an embodiment of the subject invention. Referring to FIGS. 1(*a*)-1(*d*), in an embodiment, a circularly polarized horn antenna 10 is formed based on the hollow waveguide 100 and further comprises a horn 200 connected to the hollow waveguide 100. The circularly polarized horn antenna 10 comprises the rectangular waveguide 110 receiving the LP wave, the rectangular-to-square transition part 120 connected to the rectangular waveguide 110, the square-to-hexagonal transition part 130 connected to the rectangular-to-square transition part 120, and the hexagonal waveguide 140 connected to the square-to-hexagonal transition part 130. The rectangular-to-square transition part 120 and the square-to-hexagonal transition part 130 are disposed between the rectangular waveguide 110 and the hexagonal waveguide 140; therefore, functioning as a second transition part 135.

The circularly polarized horn antenna 10 further comprises the first transition part 150 connected to the hexagonal waveguide 140 and the horn 200 connected to the first transition part 150. The first transition part 150 has a hexagonal cross section toward the hexagonal waveguide 140 and a square cross section toward the horn 200. The horn 200 can be directly connected to the first transition part 150 as shown in FIG. 1(*b*) or connected to the first transition part 150 via the square waveguide 160 such that the square waveguide 160 is disposed between the first transition part 150 and the horn 200. The horn 200 includes an inner surface 210 and can be a pyramidal horn such as a square pyramidal horn.

The hexagonal waveguide 140 can have a uniform cross section as shown in FIG. 1(*b*) or can have a tapered cross section as shown in FIG. 1(*d*). Referring to FIG. 1(*d*), a cross section of the hexagonal waveguide 140 connected to the first transition part 150 is larger than a cross section of the hexagonal waveguide 140 connected to the square-to-hexagonal transition part 130, and the cross sectional area of the hexagonal waveguide 140 reduces linearly from the first transition part 150 toward the rectangular waveguide 110. Likewise, the square-to-hexagonal transition part 130 and the first transition part 150 can also have a tapered cross section as shown in FIG. 1(*d*).

Referring to FIG. 1(*d*), a hexagonal section of the hexagonal waveguide 140 is concatenated with a tapering square pyramidal section of the pyramidal horn 200. Thus, a smooth transition is needed as the waveguide cross-section changes from rectangular to hexagonal section or vice versa. Such transitions are added as needed. The length and tapering angles for these transition waveguides are designed and optimized so as to obtain required gain, polarization purity and the return-loss across the operational frequency band. For example, design of FIG. 1(*d*) with pyramidal horn 200 is for high gain applications, while the design of FIG. 1(*c*) is for low gain applications.

Referring to FIG. 1(*c*), the circularly polarized horn antenna 10 comprises the rectangular waveguide 110 receiving LP wave, the rectangular-to-square transition part 120 connected to the rectangular waveguide 110, a tapered hexagonal waveguide 145 directly connected to the rectangular-to-square transition part 120, and a hexagonal horn 250 directly connected to the tapered hexagonal waveguide 145. The tapered hexagonal waveguide 145 has a square cross section at a first distal end 146 that is directly connected to the rectangular-to-square transition part 120, and has a hexagonal cross section at a second distal end 147 that is directly connected to the hexagonal horn 250. The tapered hexagonal waveguide 145 changes the cross section shape and the cross section area between the first distal end 146 and the second distal end 147; therefore removing the transition parts. This structure of the circularly polarized horn antenna 10 can be used to obtain a low CP gain horn.

As shown in FIGS. 1(*c*) and 1(*d*), an alternative and compact design of the circularly polarized horn antenna 10 emerges using a tapered hexagonal waveguide that allows linear to circular conversion and radiation gain. This design is compact as it uses the same hexagonal regions for polarization conversion as well as for the gain enhancements. It also allows wider bandwidth operation, useful for practical applications.

Figure 2A:
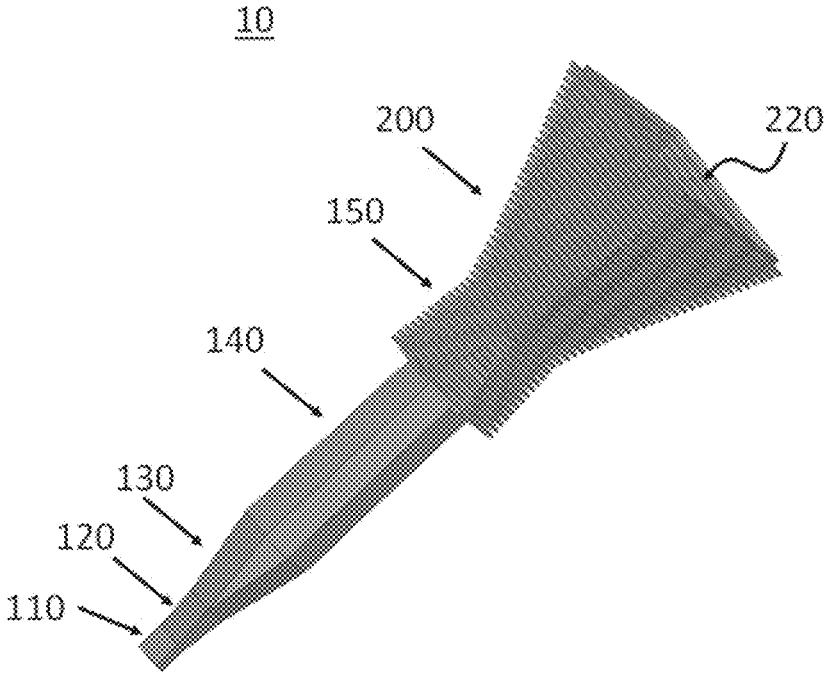
FIG. 2(*a*) shows a circularly polarized horn antenna having a corrugated inner surface according to an embodiment of the subject invention.
Figure 2B:
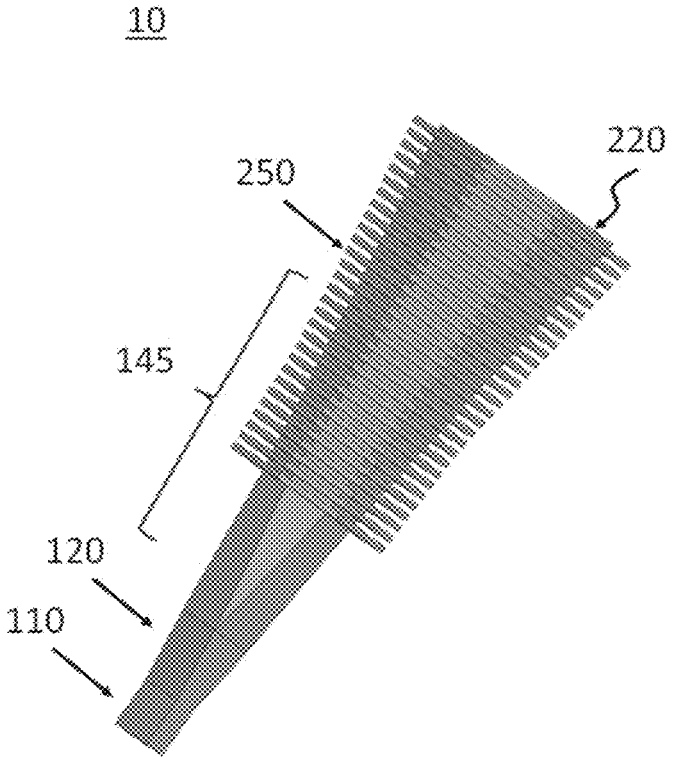
Figure 2C:
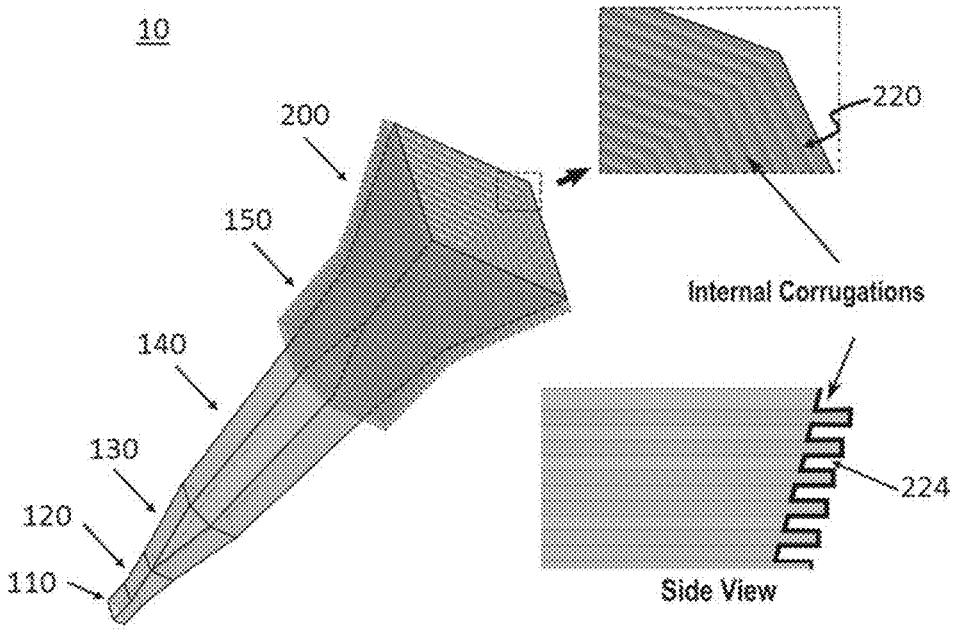
Figure 7:
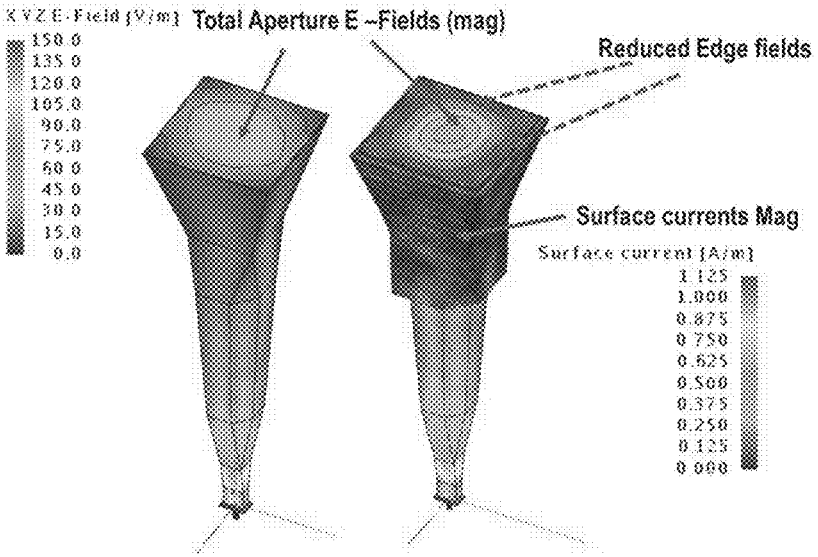
FIG. 7 shows surface currents and aperture fields within the circularly polarized horn antennas according to an embodiment of the subject invention.

FIGS. 2(*a*)-2(*c*) show circularly polarized horn antennas having a corrugated inner surface according to an embodiment of the subject invention. The circularly polarized horn antennas 10 of FIGS. 2(*a*)-2(*c*) correspond to the circularly polarized horn antennas 10 of FIGS. 1(*b*)-1(*d*), respectively, and each of circularly polarized horn antennas 10 of FIGS. 2(*a*)-2(*c*) further comprises a first corrugated inner surface 220 formed on the horn. Referring to FIGS. 2(*a*) and 2(*c*), the horn 200 includes the first corrugated inner surface 220 and the first corrugated inner surface 220 is formed by including a first plurality of grooves 224. In addition, the first corrugated inner surface 220 can be formed on the first transition part 150 and the hexagonal waveguide 140. Similarly, referring to FIG. 2(*b*), the first corrugated inner surface 220 can be formed on the hexagonal horn 250 and the tapered hexagonal waveguide 145. The circularly polarized horn antenna 10 shows the corrugated hexagonal waveguide horn for reduced cross-pol and improved gaussicity. This embodiment uses the soft-surface (corrugated surface) boundary, on the walls of the waveguide to achieve these objectives. Although waveguide provides CP waves-fields in the center of the horn-cross-section, edge fields still contribute to linearly polarized radiation, which is required to be corrected for improved performances. Corrugated walls (i.e., soft-surface, or corrugated surface), suppress the fields near the walls and thus polarization purity of the surface fields is improved. This edge field correction phenomenon is shown in FIG. 7.

Figure 3:
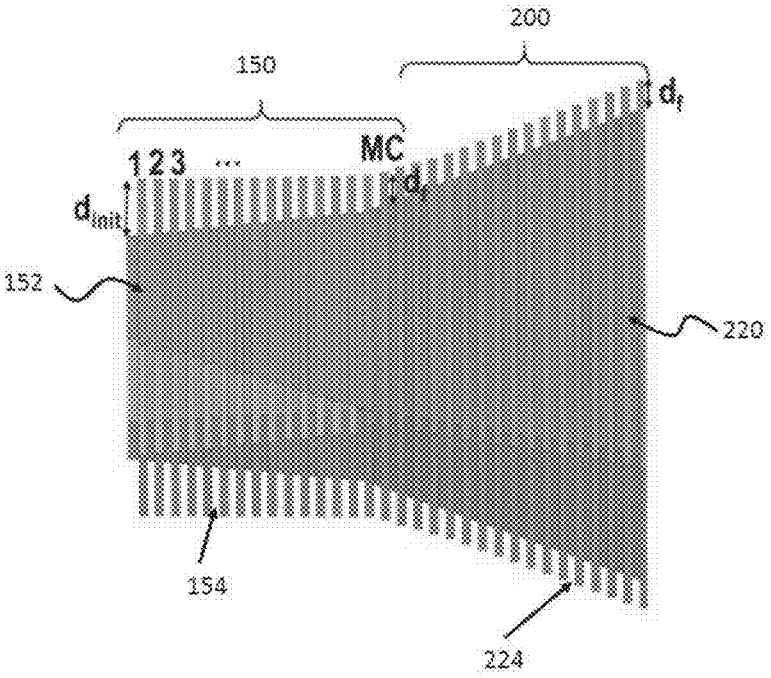
FIG. 3 shows a corrugated section of a circularly polarized horn antenna according to an embodiment of the subject invention.

FIG. 3 shows a corrugated section of a circularly polarized horn antenna according to an embodiment of the subject invention. The corrugations are applied within the inner faces of the horn. Here, corrugations refer to grooves or deep etchings cut from the inside of the waveguide. The depth, periodicity and total number of corrugations are optimized and depend on the original hexagonal horn as well as the required performances.

Referring to FIG. 3, in an embodiment, the horn 200 includes the first corrugated inner surface 220, and the first transition part 150 includes a second corrugated inner surface 152. The first corrugated inner surface 220 includes the first plurality of grooves 224, and the second corrugated inner surface 152 includes a second plurality of grooves 154. For the propagating wave to transition into the corrugated section, the depths of the corrugations need to be varied in so-called 'Matching-Section' of the first transition part 150. The depth of the corrugations is varied from an initial depth $d_{init}$ to a constant depth $d_f$. For example, the depth of the corrugation is varied linearly, exponentially, quadratic, and etc. The corrugation depth remains constant from thereon till the end of the waveguide. For the design of corrugations, two parameters $d_{init}$ and MC (number of corrugations in matching section) are required to be optimized to obtain the desired performance. Similar to the first transition part 150 including the second corrugated inner surface 152 formed by the second plurality of grooves 154, the hexagonal waveguide 140 can have a third corrugated inner surface formed by a third plurality of grooves. Referring to FIGS. 2(*b*) and 3, the first corrugated inner surface 220 including the first plurality of grooves 224 can be formed on the hexagonal horn 250 and the second corrugated inner surface 152 including the second plurality of grooves 154 can be formed on the tapered hexagonal waveguide 145.

Figure 4:
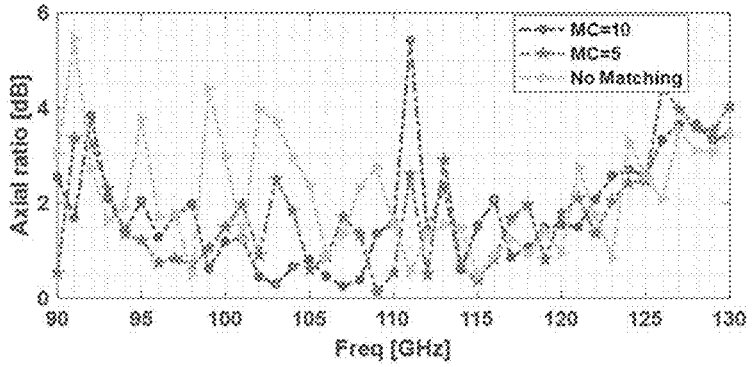
FIG. 4 shows effect of the length of matching section of a corrugated section (or number of corrugations) according to an embodiment of the subject invention.

FIG. 4 shows effect of the length of matching section (i.e.; MC count (number of corrugations)) of a corrugated section according to an embodiment of the subject invention. Referring to FIG. 4, if the MC count is zero, the axial ratio of the far-field broadside radiation varies severely across the band. This is also observed as oscillatory behavior of the AR value across the frequency band as in FIG. 4. It is higher than 3 dB at several frequency points, which is not acceptable for many applications. However, using MC=5 and 10, the axial ratio performance is improved. That is, longer matching (or higher MC count) allows smoother and below 3 dB axial ratio performance. For example, the embodiment using MC=20 can show the best performance.

Figure 5:
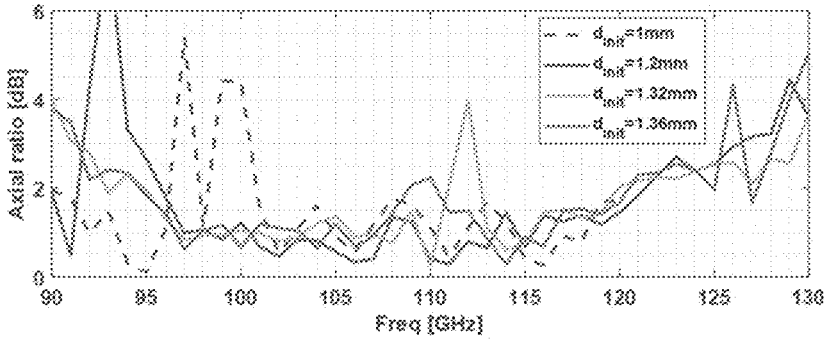
FIG. 5 shows effect of the depth of a corrugated section according to an embodiment of the subject invention.

FIG. 5 shows effect of the depth of a corrugated section according to an embodiment of the subject invention. The choice of the constant depth $d_f$ is generally fixed to $d_f=\lambda_{mid}/4$, where $\lambda_{mid}$ is the mid-band wavelength. The mid-band wavelength refers to wavelength corresponding to the frequency at the center of the frequency band. In the considered case in FIG. 5, this refers to wavelength for 110 GHz, i.e. 2.72 mm. The initial depth $d_{init}$ of the second plurality of grooves 154, however, needs to be optimized for optimal performance. Effect of the initial depth $d_{init}$ on the antenna far-field performance is shown in FIG. 5, and the corrugated section having $d_{init}$ of 1.2 mm provides low broadside axial ratio in a continuous band. Therefore, the value of $d_{init}$ can be chosen to be around 1.2 mm for the uniform performance of the antenna in the 95-140 GHz band of interest.

Figure 6A:
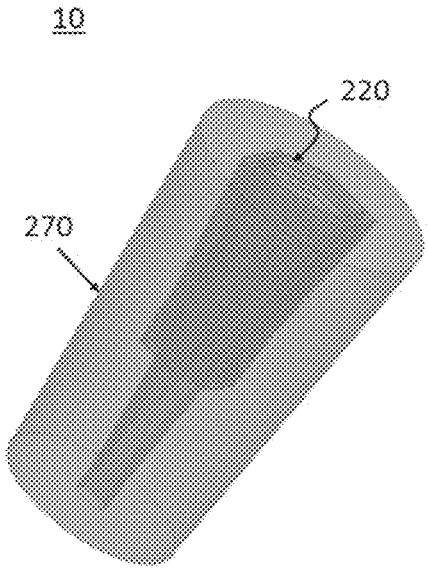
FIG. 6(*a*) shows a circularly polarized horn antenna having cylindrical outer structure according to an embodiment of the subject invention.
Figure 6B:
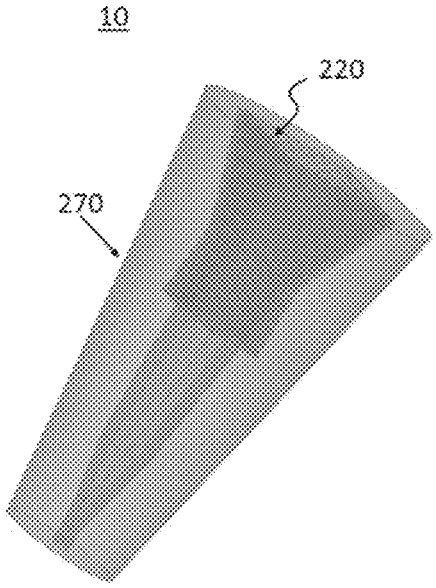

Embodiments of the subject invention as shown in FIGS. 1(*a*)-2(*c*) are related to inner surfaces of the hollow waveguides and the circularly polarized horn antennas. The outer structures may take any shape or form. FIGS. 6(*a*) and 6(*b*) show practical embodiments of the circularly polarized horn antenna. Referring to FIG. 6(*a*), a whole inner structure of the circularly polarized horn antenna 10 corresponds to the embodiments described in FIG. 2(*b*), and the circularly polarized horn antenna 10 further comprises an outer surface 270 having cylindrical outer structure. Referring to FIG. 6(*b*), a whole inner structure of the circularly polarized horn antenna 10 corresponds to the embodiments described in FIG. 2(*c*), and the circularly polarized horn antenna 10 further comprises an outer surface 270 having conical outer structure. The horns and waveguides may be carved out from a block of metal and may be formed integrally or monolithically. Any outer structures (e.g., conical, cylindrical, square pyramidal) are possible and can be used as appropriate.

FIG. 7 shows surface currents and aperture fields within the circularly polarized horn antennas according to an embodiment of the subject invention. FIG. 7 shows the performance and operation of horn antennas shown in FIGS. 1(*d*) and 2(*c*) that are the horn antenna without a corrugated surface and the horn antenna with a corrugated surface, respectively. The surface currents and aperture fields of the horn antennas are recorded from the simulations at 110 GHz. Referring to FIG. 7, both embodiments show strong field-confinement at the center of the aperture, illustrating efficient radiation, and the corrugation suppresses fields along the edges, which improves the CP performance of the antenna with corrugations. Specifically, a reduction in cross-polarized radiation is expected by suppression of edge fields.

Figure 8:
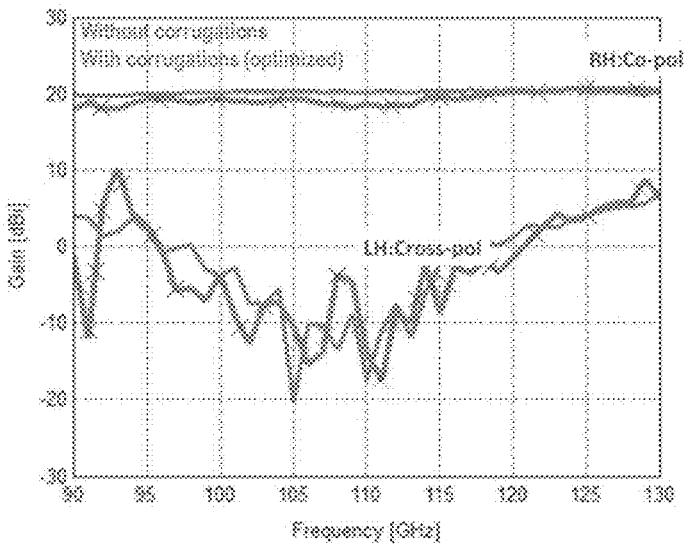
FIG. 8 shows Co-pol and cross-pol gain of the circularly polarized horn antenna without corrugation and the circularly polarized horn antenna with corrugation according to an embodiment of the subject invention.
Figure 9:
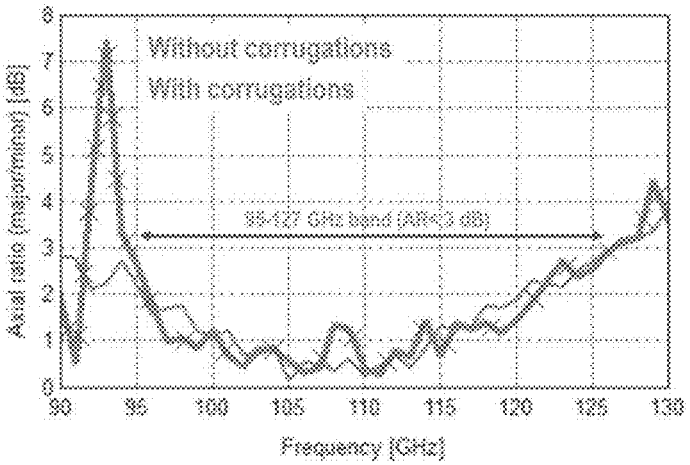
FIG. 9 shows axial ratio versus frequency sweeps of the circularly polarized horn antenna without corrugation and the circularly polarized horn antenna with corrugation according to an embodiment of the subject invention.

FIG. 8 shows Co-pol and cross-pol gain of the circularly polarized horn antenna without corrugation and the circularly polarized horn antenna with corrugation according to an embodiment of the subject invention. FIG. 9 shows axial ratio versus frequency sweeps of the circularly polarized horn antenna without corrugation and the circularly polarized horn antenna with corrugation according to an embodiment of the subject invention. Referring to FIGS. 8 and 9, the broadside gain of the two antennas is quite similar and confirms the operation. It is noted that corrugations improve the radiation performance in the off-broadside directions and broadside performance remains unchanged. In addition, both antennas show ≈20 dBi co-polarized gain across the frequency band, with axial ratio below 3 dB for 32 GHz bandwidth, illustrating a wideband performance of the antennas.

Figure 10:
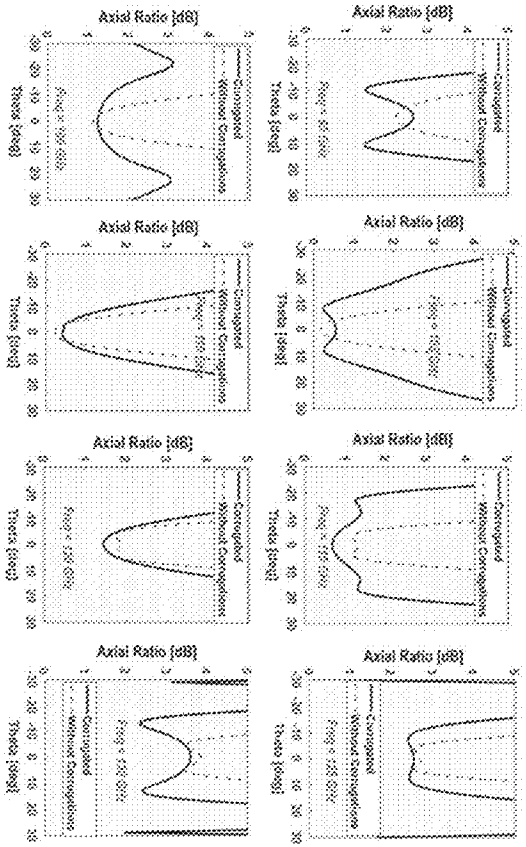
FIG. 10 shows far-field axial ratio as a function of elevation angle in the circularly polarized horn antenna without corrugation and the circularly polarized horn antenna with corrugation according to an embodiment of the subject invention.

FIG. 10 shows far-field axial ratio as a function of elevation angle in the circularly polarized horn antenna without corrugation and the circularly polarized horn antenna with corrugation according to an embodiment of the subject invention. Theta=0 represents broadside direction. The horn antenna with corrugation has polarization pure radiation (axial ratio<3 dB) in a wider angular range for all frequencies, which means beam width enhancement.

Figure 11:
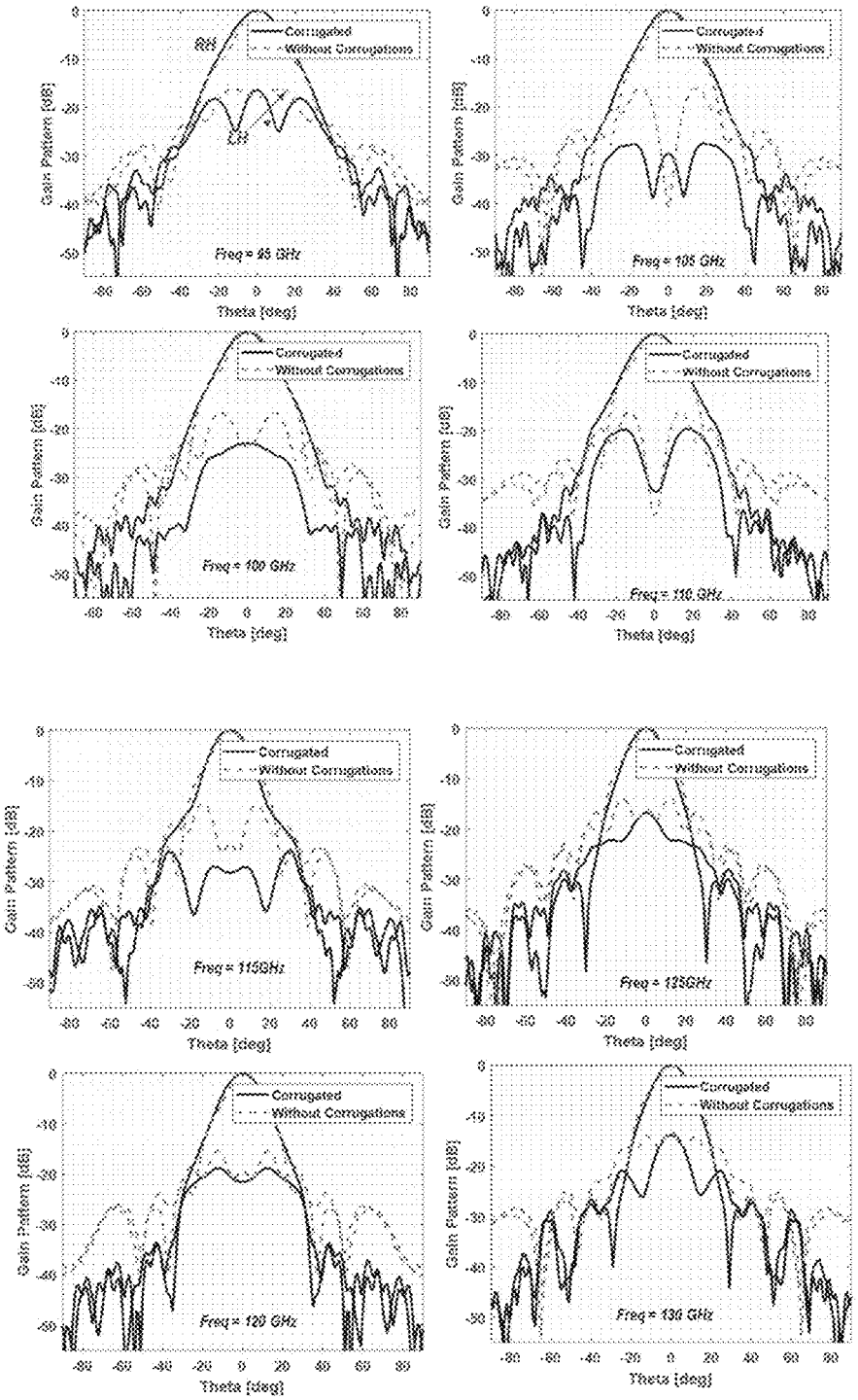
FIG. 11 shows far-field radiation patterns in the circularly polarized horn antenna without corrugation and the circularly polarized horn antenna with corrugation according to an embodiment of the subject invention.

FIG. 11 shows far-field radiation patterns in the circularly polarized horn antenna without corrugation and the circularly polarized horn antenna with corrugation that correspond to the circularly polarized horn antennas of FIG. 1(*d*) and FIG. 2(*c*), respectively, with respect to frequencies 90 GHz to 130 GHz. Referring to FIG. 11, the circularly polarized horn antenna with corrugation shows improved cross-pol performance in ±20° elevation angles as LH component has decreased and shows improved side lobe level performances.

Referring to FIGS. 10 and 11, distinction between the circularly polarized horn antenna without corrugation and the circularly polarized horn antenna with corrugation is clear from their far-field radiation performances. As shown in FIGS. 10 and 11, the CP radiation in the designs is based on linear-to-circular conversion in hexagonal waveguide. In circularly polarized horn antenna without corrugation, fields are not completely circularly polarized near the walls of the waveguide, leading to high cross-polarization in off-broadside elevation angles. However, by introducing the corrugations in the horn as shown FIG. 2(*c*), these surface-fields are suppressed, and the cross-polar radiation of the antenna is improved. These advantages are illustrated for different frequencies within the band of interest in FIGS. 10 and 11. Specifically, FIG. 10 shows increased 3-dB axial ratio beam-width across the frequency band, and FIG. 11 shows suppressed cross-polarized pattern (i.e. LH component).

Embodiments of the subject invention provide a class of waveguides and horn antennas that provide circularly polarized radiation. The antennas are easy to fabricate especially for sub-mm-wave and terahertz frequencies. The antennas can use hexagonal cross-sectional waveguides. Further improvement in performance can be achieved by using corrugations along the walls of the horn. The beam-gaussicity and cross-pol improvements were observed in corrugated hexagonal horn confirming the merits of embodiments of the subject invention.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. A circularly polarized horn antenna, comprising:

a hollow waveguide including a rectangular waveguide and a hexagonal waveguide connected to the rectangular waveguide; and a horn connected to the hexagonal waveguide;

the horn including a first corrugated inner surface.

2. The circularly polarized horn antenna according to claim 1, the first corrugated inner surface including a first plurality of grooves.

3. The circularly polarized horn antenna according to claim 2, the first plurality of grooves having a constant depth.

4. The circularly polarized horn antenna according to claim 1, the hollow waveguide including a second corrugated inner surface.

5. The circularly polarized horn antenna according to claim 4, the second corrugated inner surface including a second plurality of grooves.

6. The circularly polarized horn antenna according to claim 5, the second plurality of grooves having variable depths.

7. The circularly polarized horn antenna according to claim 6, the variable depth varying linearly toward the horn.

8. The circularly polarized horn antenna according to claim 1, the hollow waveguide comprising a first transition part between the hexagonal waveguide and the horn.

9. The circularly polarized horn antenna according to claim 8, the first transition part having a hexagonal cross section facing the hexagonal waveguide and a square cross section facing the horn.

10. The circularly polarized horn antenna according to claim 9, a cross section of the hexagonal waveguide being tapered from the first transition part to the rectangular waveguide.

11. The circularly polarized horn antenna according to claim 8, the hollow waveguide comprising a second transition part between the rectangular waveguide and the hexagonal waveguide.

12. The circularly polarized horn antenna according to claim 11, the second transition part including a rectangular-to-square transition part connected to the rectangular waveguide and a square-to-hexagonal transition part connected to the hexagonal waveguide.

13. The circularly polarized horn antenna according to claim 1, the horn being directly connected to the hexagonal waveguide and having a hexagonal cross section.

14. A circularly polarized horn antenna, comprising:

a rectangular waveguide;

a hexagonal waveguide connected to the rectangular waveguide;

a first transition part connected to the hexagonal waveguide; and a horn connected to the first transition part;

the horn including a first corrugated inner surface, and the first transition part including a second corrugated inner surface.

15. The circularly polarized horn antenna according to claim 14, the first transition part having a hexagonal cross section toward the hexagonal waveguide and a square cross section toward the horn.

16. The circularly polarized horn antenna according to claim 15, further comprising a rectangular-to-square transition part connected to the rectangular waveguide and a square-to-hexagonal transition part connected between the rectangular-to-square transition part and the hexagonal waveguide.

17. The circularly polarized horn antenna according to claim 16, the first corrugated inner surface comprising a first plurality of grooves having a constant depth and the second corrugated inner surface comprising a second plurality of grooves having a variable depth.

18. The circularly polarized horn antenna according to claim 17, the first plurality of grooves being disposed periodically and the constant depth being a quarter of a mid-band wavelength.

19. The circularly polarized horn antenna according to claim 15, the horn being a pyramidal horn.

20. A circularly polarized horn antenna, comprising:

a rectangular waveguide;

a rectangular-to-square transition part connected to the rectangular waveguide;

a square-to-hexagonal transition part connected to the rectangular-to-square transition part;

a hexagonal waveguide connected to the square-to-hexagonal transition part;

a first transition part connected to the hexagonal waveguide; and a pyramidal horn connected to the first transition part;

the pyramidal horn including a first plurality of grooves having a constant depth, and the first transition part including a second plurality of grooves having a variable depth.

* * * * *